United States Patent [19]

Roig et al.

[11] Patent Number: 4,667,688

[45] Date of Patent: May 26, 1987

[54] MINI PACK OF CIGARETTES

[76] Inventors: Francisco Roig; George Spector, both of 233 Broadway, Rm. 3615, New York, N.Y. 10007

[21] Appl. No.: 555,582

[22] Filed: Nov. 28, 1983

[51] Int. Cl.[4] ..... A24F 15/00; A24F 15/08

[52] U.S. Cl. ..... 131/329; 206/242

[58] Field of Search ..... 131/329; 206/242

[56] References Cited

U.S. PATENT DOCUMENTS

| | | | |
|---|---|---|---|
| 1,972,118 | 9/1934 | McDill | 131/329 |
| 2,764,984 | 10/1956 | Cohen et al. | 206/242 |
| 2,771,988 | 11/1956 | Sweeney | 206/242 |
| 2,803,391 | 8/1957 | Koeble | 206/242 |
| 3,092,301 | 6/1963 | Selle | 206/242 |
| 3,226,010 | 12/1965 | Rogers | 229/87 C |
| 3,592,337 | 7/1971 | Phillips | 206/242 |
| 4,310,007 | 1/1982 | Auersbacher | 131/329 |

FOREIGN PATENT DOCUMENTS

| | | | |
|---|---|---|---|
| 973980 | 9/1950 | France | 131/329 |

*Primary Examiner*—V. Millin

[57] ABSTRACT

A mini-pack of cigarette is provided and consists of an envelope of "cellophane" or the like sealed around a container for storing a plurality of small cigarettes and a small cigarette holder placed on top of the container. A plurality of the mini-pack of cigarettes are attached by the envelopes along sides of the containers forming a horizontal strip. A pull string is used to separate each mini-pack of cigarettes from the strip and at the same time separate the envelopes to remove the small holder.

5 Claims, 3 Drawing Figures

MINI PACK OF CIGARETTES

BACKGROUND OF THE INVENTION

The instant invention relates generally to cigarettes and more specifically it relates to a mini-pack of cigarettes.

Numerous cigarette accessories have been provided in prior art that are adapted to hold cigarettes. For example, U.S. Pat. Nos. 931,582; 1,967,204; 2,147,510 and 2,148,411 all are illustrative of such prior art. While these units may be suitable for the particular purpose to which they address, they would not be suitable for the purposes of the present invention as heretofore described.

SUMMARY OF THE INVENTION

A principle object of the present invention is to provide a mini-pack of cigarettes that contains a plurality of small cigarettes and a small cigarette holder therein.

Another object is to provide a mini-pack of cigarettes that come in a plurality to form a horizontal strip and a pull string for removing one mini-pack of cigarettes at a time from the strip.

An additional object is to provide a mini-pack of cigarettes that uses the same pull string for removing the holder from the mini-pack of cigarettes.

A further object is to provide a mini-pack of cigarettes that is simple and easy to use.

A still further object is to provide a mini-pack of cigarettes that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 2:
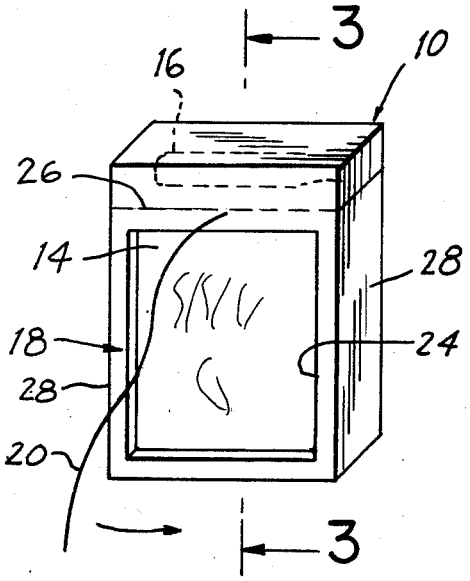
FIG. 2 is a perspective view of one mini-pack of cigarettes separated from the strip with pull string separating the envelope so that small holder can be removed from top of the container.
Figure 3:
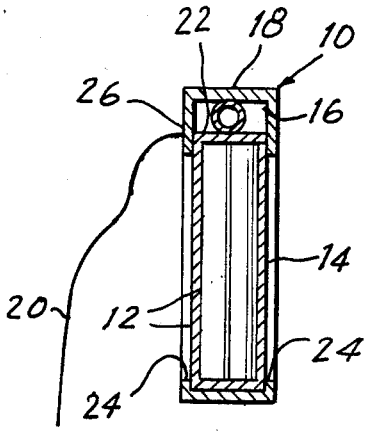
FIG. 3 is a cross sectional view taken along line 3—3 in FIG. 2.

Turning now descriptively to the drawings, in which similar reference characters denote similar elements throughout the several views, FIGS. 2 and 3 illustrates a mini-pack of cigarettes 10 that consists of a plurality of small cigarettes 12, a container 14, a small cigarette holder 16, an envelope of "cellophane" or the like 18 and a pull string 20.

Each small cigarette 12 is half the size of a standard cigarette, about two inches to two and one half inches long. The container 14 is for storing the small cigarettes 12 that come twenty to the container. The small cigarette holder 16 is two inches long and made out of plastic material so that each small cigarette 12 can be entirely smoked. The small cigarette holder 16 is placed on top 22 of the container 14. The envelope 18 is sealed around the container 14 and the small cigarette holder

16. A window 24 can be formed on both front and back to allow the logo of the container 14 to show if so desired. The pull string 20 is for separating the envelope 18 at 26 so that the small holder 16 can be removed from top 22 of the container 14 and the container 14 can be opened to remove contents of the small cigarettes 12 therefrom.

Figure 1:
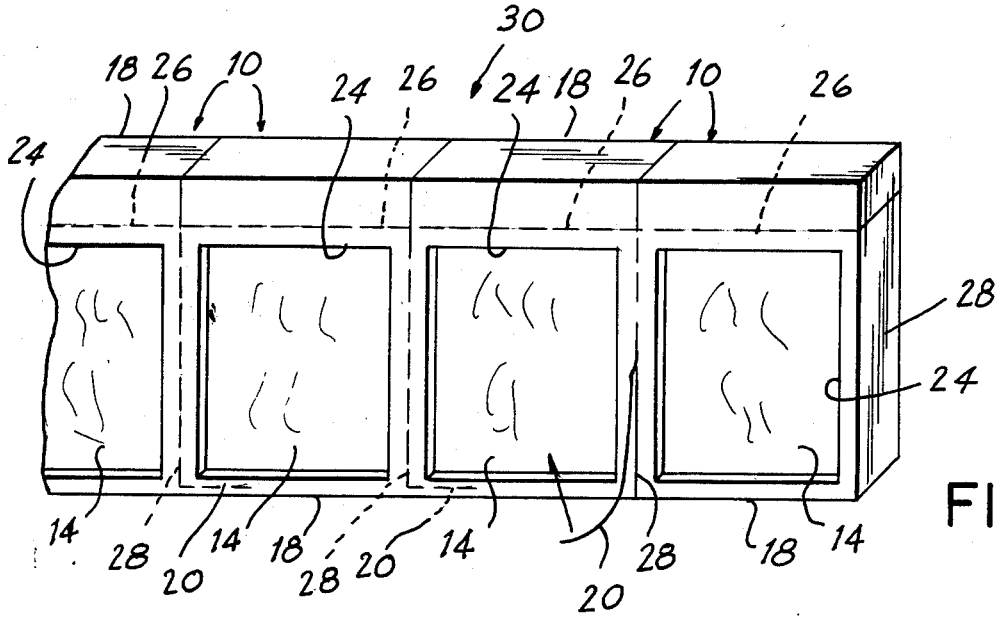
FIG. 1 is a perspective view of a plurality of a mini-pack of cigarettes forming a horizontal strip thereof.

As shown in FIG. 1 a plurality of the mini-pack of cigarettes 10 are attached to the envelopes 18 along sides 28 of the container 14 forming a horizontal strip 30 thereof. The pull string 20 is also used for separating each envelope 18 along side 28 of each container 14 so that each mini-pack of cigarettes 10 can be removed from the strip 30.

The mini-pack of cigarettes 10 will be about two to two and one half inches long, two inches wide and a half inch thick. It will fit into all cigarette vending machines without any major change to the mechanism. The cigarettes 12 will be made with filter tips or regular tips. The cigarette holder 16 can be placed inside the container 14 instead of on top 22 as shown in FIG. 3. If the holder 16 is placed inside the container 14 only nineteen cigarettes will be used. The holder 16 will take the place of the twentieth cigarette 12. The price of the mini-pack of cigarettes can be half of a standard pack of cigarettes for actually the consumer is buying only one half the amount.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A mini-pack of cigarettes which comprises:

(a) a plurality of cigarettes;

(b) a container for storing said cigarettes having a removeable cover;

(c) a cigarette holder stored on said cover;

(d) an envelope sealed around said container and over said cigarette holder; and (e) means for separating said envelope so that said holder can be removed from said container and said container can be opened to remove contents of said cigarettes therefrom.

2. A mini-pack of cigarettes as recited in claim 1, that further comprises:

(a) a plurality of said mini-pack of cigarettes attached by said envelopes along sides of said containers forming a horizontal strip thereof; and (b) means for separating each said envelope along side of each container so that each said mini-pack of cigarettes can be removed from the strip.

3. A mini-pack of cigarettes as recited in claim 2, wherein said means for separating each said envelope along side of each said container so that each said mini-pack of cigarettes can be removed from the strip and means for separating said envelopes so that said holder can be removed from top of said container and said container can be opened to remove contents of said cigarettes therefrom being a pull string.

4. A mini-pack of cigarettes as recited in claim 3, wherein each said cigarette will be half the size of a standard cigarette and come twenty to said container.

5. A mini-pack of cigarettes as recited in claim 4, wherein each said cigarette holder will be of predetermined length so that each said cigarette can be entirely smoked.

* * * * *